US006352460B1

(12) United States Patent
Eiband et al.

(10) Patent No.: US 6,352,460 B1
(45) Date of Patent: Mar. 5, 2002

(54) NEUTRAL BUOYANCY RECOVERY DEVICE

(75) Inventors: David M. Eiband; Meredith K. Eiband, both of Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/617,021

(22) Filed: Jul. 14, 2000

(51) Int. Cl.[7] ..... B63C 9/00
(52) U.S. Cl. ..... 441/80; 5/625; 440/129
(58) Field of Search ..... 441/80, 90, 92, 441/129, 40, 41; 114/331, 333, 44, 345, 360, 68, 69; 5/625, 626

(56) References Cited

U.S. PATENT DOCUMENTS 2,519,376 A * 8/1950 Jennings ..... 441/80
3,133,295 A * 5/1964 Klingensmith ..... 441/80
RE28,916 E * 7/1976 Rice et al.
4,389,961 A * 6/1983 Parish ..... 114/345
4,473,912 A 10/1984 Schedai et al.
4,621,382 A * 11/1986 Burriss et al. ..... 441/129
4,907,674 A 3/1990 Miller
5,354,222 A 10/1994 Elias
5,687,664 A 11/1997 Sofian
6,053,534 A 4/2000 Timmerman

* cited by examiner

*Primary Examiner*—Sherman Basinger
(74) *Attorney, Agent, or Firm*—Anthony J. Serventi

(57) ABSTRACT

A neutral buoyancy recovery device (NBRD) for retrieving an immobile object or incapacitated individual from a liquid area which utilizes neutral buoyancy to assist a rescuer. The NBRD is easily submerged under the surface of the liquid and placed under an object to be recovered. At least one bladder attached to the NBRD is inflated to create positive buoyancy and propel the object to the liquid surface. The bladder(s) is located in a space between two panels, which are connected to form one unit. The bladder(s) inflated manually or by using compressed gas canisters. Various straps and ropes are used to stabilize the object or individual as the NBRD is maneuvered through the surface of the liquid.

19 Claims, 6 Drawing Sheets

NEUTRAL BUOYANCY RECOVERY DEVICE

The invention described herein may be manufactured and used by or for the government of the United States of America for governmental purposes without the payment of any royalties thereon or therefor.

MICROFICHE APPENDIX

Not Applicable.

BACKGROUND OF THE INVENTION

1. Field of the Invention

The present invention relates to the field of water retrieval devices and more particularly, to an evacuation/rescue backboard that inflates to create positive buoyancy which assists in the removal of an injured individual from a perilous water area, such as a pool, ocean or lake. More particularly, a preferred embodiment of the present invention assists in the removal of an is injured individual who has incurred a spinal injury.

2. Description of the Related Art

Water rescue of a victim who is injured, trapped or in danger of drowning often requires the rescuer to put himself in similar danger. The danger is even greater in situations involving turbulent water such as rapid flowing currents of a river or large tides of a lake or ocean. To this end, it is known to provide floatation devices which may be used by a rescuer to reach the victim from a remote position. Rescue from a remote location often allows the rescuer to reach the victim more quickly and involves less risk of harm to the rescuer. Commonly known such devices include ring-shaped life preservers having a rope attached so that the rescuer may toss the life preserver to the victim and pull the victim to safety. One difficulty in using a life preserver for rescue is guiding the life preserver to the victim. If the initial throw of the life preserver does not place it sufficiently close to the victim, the rescuer must pull the life preserver in and make further throws, resulting in lost time and effort. Storage and transportation of bulky floatation devices is another common problem since the rescuer often must carry several pieces of equipment to the rescue site.

The prior art deep water spinal injury technique first involves the lifeguard bringing the injured victim to the comer of the pool head first with the victim's face out of the face water and body bisecting the angle of the corner. Two assistants then maneuver the backboard under the injured victim. With the backboard in place, a plurality of retention straps are carefully tied around the victim to the board in the ankle area, knee area, waist area, chest area, and lastly, around the head to immobilize the neck and spine as much as possible before lifting the victim from the pool. In the prior art method, the actual lifting from the pool had to be done by persons out of the pool which was particularly difficult since the injured victim on the backboard had to be held horizontal at all times, both in the water and upon lifting from the water.

Current backboard configurations are designed so that the backboard has sufficient positive buoyancy to support the victim in the water. This positive buoyancy, of course, greatly complicates placement of the backboard under the victim because the rescuers must physically overcome that buoyancy to complete the placement task. Clearly if only the minimum two rescuers are available, placement of the backboard will be difficult at best. In fact, many smaller lifeguards cannot force the positively buoyant standard backboard underwater without assistance. The same problems and limitations arise when attempting to retrieve or transport other immobile objects from the water. For example, scuba divers and snorklers often need assistance in transporting various treasures discovered on the floors of lakes, oceans or rivers.

Numerous innovations for aquatic retrieval devices have been provided in the prior art that are described as follows. None of these existing inventions, however, describes the design or concept of the present invention. Even though these innovations may be suitable for the specific individual purposes to which they address, they differ from the present invention and are contrasted as follows.

U.S. Pat. No. 4,907,674, issued to Miller on Mar. 13, 1994, is a mechanical assembly to remove spinal-type injuries from deep water. The assembly is used to facilitate the often-difficult removal of the victim from deep water by increasing the mechanical advantage of the lifting process. While using a standard backboard, this patent does not discuss nor use either positive or neutral buoyancy techniques, a central concept of the Neutral Buoyancy Backboard design.

U.S. Pat. No. 4,473,912, issued to Scheidel et al. on Oct. 2, 1984, discloses a backboard design that can be sterilized and a backboard which is corrosive, splinter, rot, and stain resistant; and does not interfere with X-rays. Also, the design can clearly be used in an aquatic environment and discusses buoyancy as an attribute of its design. However, U.S. Pat. No. 4,473,912 does not disclose an apparatus that utilizes inflatable bladders to create positive buoyancy.

U.S. Pat. No. 6,053,534, issued to Timmerman on Apr. 25, 2000, uses an inflatable evacuation/rescue sled to transport a victim already secured to a backboard. The backboard-secured victim is placed in the sled, the sled is inflated, and the sled is used for transport across floors, down stairs, or in difficult-to-navigate areas. The backboard in this design is in a standard configuration, and the buoyancy of the backboard is not a factor. While the design does use inflation to form the sled, that inflation occurs after the victim is stabilized, not before stabilization as is one aspect of a preferred embodiment of the present invention U.S. Pat. No. 5,354, 222, issued to Elias on Oct. 11, 1994, the Water Rescue Sled, is a buoyant body configured to support a recumbent victim behind a towed vehicle. The sled is designed with stiffness adequate to support a spinal injury victim. The sled is not inflatable nor does it change buoyancy.

U.S. Pat. No. 5,687,664, issued to Sofian on Nov. 18, 1997 discloses an inflatable pontoon for performing multiple water rescue operations, and adding longitudinal sections may extend the pontoon. A backboard may be suspended between two pontoons. The backboard in this application is a standard configuration, and the victim is already secured to the backboard before loading. Buoyancy changes are not utilized to effect securing the victim to the backboard.

SUMMARY OF THE INVENTION

In view of the foregoing, it is an object of a preferred embodiment of the present invention to provide a neutral buoyancy recovery device (NBRD) adapted for aquatic retrieval where only one rescuer is necessary to retrieve an object and only two rescuers are needed to remove an injured victim from water. A preferred embodiment of the present invention provides a backboard designed with neutral buoyancy, which will allow the backboard to be moved easily underwater into the proper position under an incapacitated individual or other relatively immobile object. Once in position under the immobile object, a compressed air cylinder is activated, inflating at least one bladder on the under side of the backboard and providing the positive buoyancy required to support the object in the water. Also, the bladder(s) may be inflated manually by blowing into a tube connected to the bladder(s). The principle behind the NBRD is the elimination of the resistance caused by positive buoyancy until that positive buoyancy is utilized to remove the incapacitated individual or other immobile object from the water.

A preferred embodiment of the present invention further comprises a plurality of ties for facilitating securing of an incapacitated individual or object upon the buoyant body thereto. Ropes, straps, webbing, nets, etc. may be attached to the ties and placed over the object so as to maintain the individual or object safely upon the upper surface of the NBRD. Although handles are part of the NBRD surface, the ties are preferably configured as handles so as to facilitate carrying of the NBRD and object. Thus, when used as a water rescue device, the NBRD of the present invention may optionally function as a backboard for maintaining the spine in a straight and immobile configuration during transport.

Other accessories may include a head restraint assembly for substantially immobilizing the head of a patient and/or applying cervical traction when secured and arranged on the backboard, a plurality of adjustable tie-down straps which may be clipped anywhere along the periphery of the board, as well as supplemental carrying handles including securing clips enabling them to be clipped on the periphery of the board at desired locations. In addition, the NBRD may include handhold apertures, which allow the use of conventional straps and/or provide additional handholds for rescuers using the NBRD.

One object of a preferred embodiment of the present invention is to provide an aquatic rescue backboard, which is compact and easily implemented.

Another object of a preferred embodiment of the present invention is to provide a neutral buoyancy recovery device for transport of large or heavy objects from aquatic areas having inflating bladders to allow one individual to effectively stabilize the objects and remove the objects from the aquatic area.

Another object of a preferred embodiment of the present invention is to provide an aquatic rescue backboard, which utilizes the concept of neutral buoyancy to assist in rescuing an injured individual from an aquatic area. Neutral buoyancy allows one rescuer to maneuver the NBRD under an individual without struggling.

Yet another object of a preferred embodiment of the present invention is to provide a neutral buoyancy recovery device which acts as a backboard for transporting injured or incapacitated individuals form perilous aquatic areas and provide easy access to handles and straps used to carry and stabilize an incapacitated individual.

DETAILED DESCRIPTION OF THE INVENTION

Figure 1:
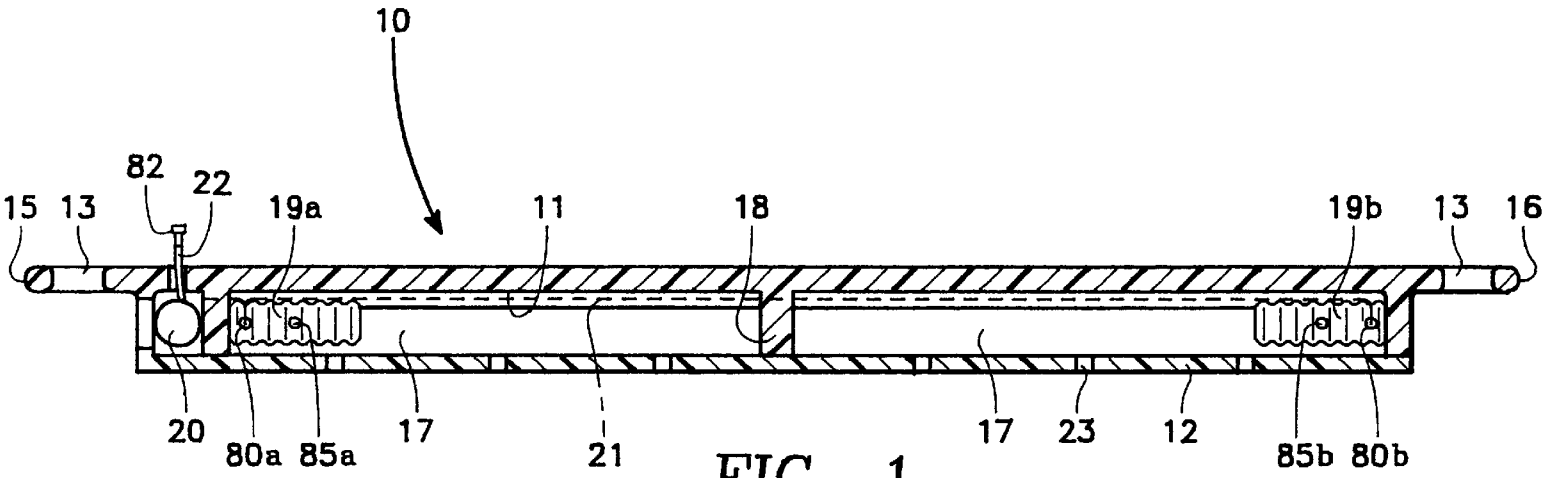
FIG. 1 illustrates a lateral side view of a preferred embodiment of the present invention with two bladders in an uninflated condition
Figure 4:
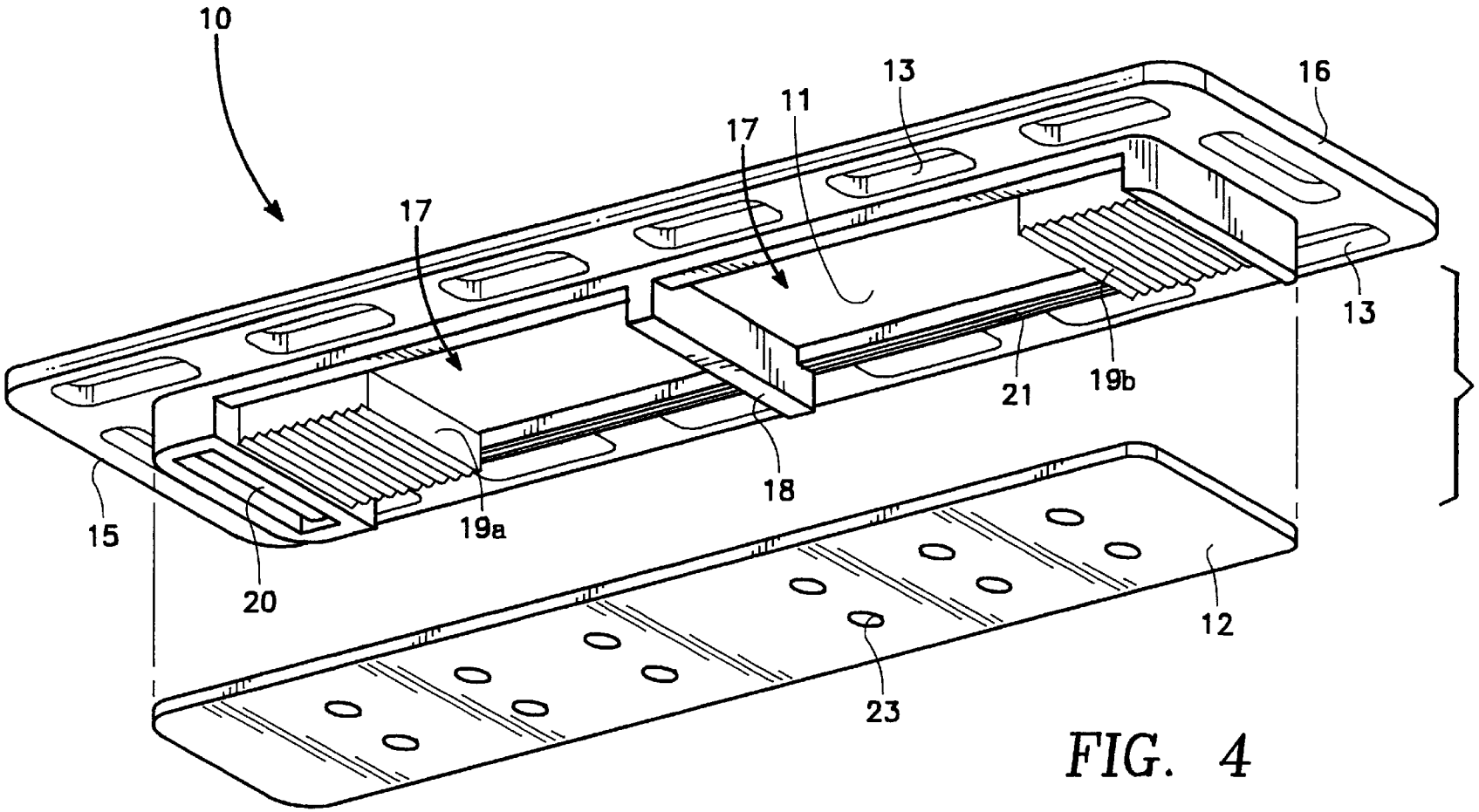
FIG. 4 illustrates a preferred embodiment of the present invention in which air canisters are utilized to inflate two inflatable bladders.

A preferred embodiment of the present invention is depicted in FIG. 1. The NBRD 10 is constructed of a shape that is typical of a boat when seen in the top view. A first panel 11 forms the foundation of the NBRD 10 and a second panel 12 is used in connection with the first panel 11 to form the NBRD 10. The NBRD assembly 10 includes two generally rectangular, lightweight, substantially rigid panels 11 and 12 preferably molded from a resinous plastic material such as polycarbonate or modified phenylene oxide or any waterproof buoyant material. Both panels 11 and 12 are approximately 72" by 18" in a preferred form. The first or upper panel 11 includes a substantially planar area, a series of laterally aligned, rectangular handhold apertures 13 adjacent the lateral edges thereof. In a preferred embodiment of the present invention, the second or bottom panel 12 also has a generally rectangular shape but is slightly smaller than the first panel 11 so as to nest within the top panel 11 therein when the panels are fitted together. The first panel 11 and the second panel 12 may be connected using a variety of means including adhesives, buckles, screws and clips. Also, this design permits easy access to the apertures 13 that act as handles, when transporting the object in or out of the liquid. The panels are connected at the bow 15 and stern 16 to create one unit with a space or void 17 between the two panels 11 and 12. As illustrated in FIG. 4, the space or void 17 between panels 11 and 12 creates an opening through the sides of the device 10 through which liquid, such as water, may ingress and egress. In a preferred embodiment, the second panel 12 is equipped with perforations 23 to assist the ingress and egress of liquid from within the space or void 17.

Figure 3:
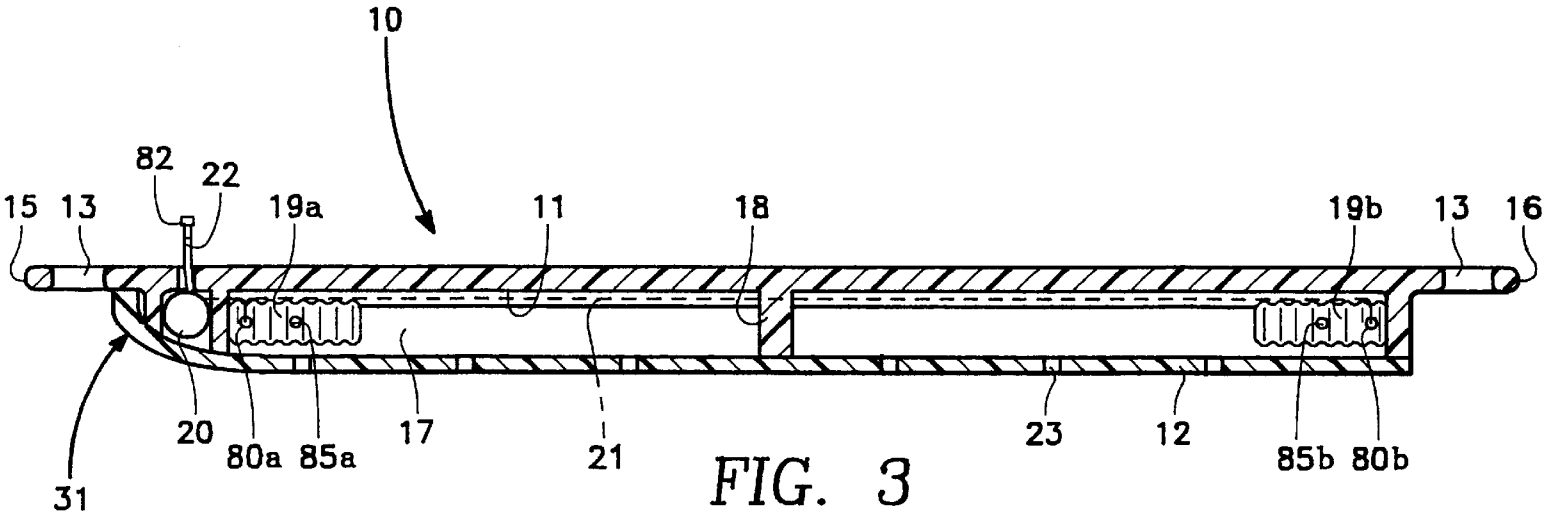
FIG. 3 illustrates a lateral side view of a preferred embodiment of the present invention in which the bow of the NBRD has a hydrodynamic shape.

Referring to FIG. 3, in a preferred embodiment of the present invention, the bow 15 incorporates a hydrodynamic shape 31 to reduce resistance as the NBRD 10 is maneuvered through a liquid. The shape is similar to the bow of a watercraft, such as a boat, ship or canoe. Because of the hydrodynamic shape of the NBRD 10, the rescuer can maneuver the NBRD 10 into various angles of attack. By maneuvering the NBRD 10 into particular angles of attack, the hydrodynamic shape of the NBRD 10 allows the NBRD 10 to move forward against the direction of a flowing current that would occur in areas such as rivers or oceans.

To better describe the operation of the NBRD 10, an embodiment incorporating 2 bladders will be detailed. The following description is not intended to limit the possible utilities of the present invention. Referring to FIG. 1, in a preferred embodiment of the present invention, a rib 18 is centrally located in the space 17 between the first and second panels 11 and 12 and two bladders 19*a* and 19*b* are utilized, one bladder at the bow 19*a* and one bladder at the stem 19*b*. In this embodiment, the bladders 19*a* and 19*b* inflate toward the rib 18. This rib 18 acts as a support between the first and second panels 11 and 12, when heavier objects are retrieved.

Referring to FIG. 1, the first panel 11 allows an object to be situated thereon. The second panel 12 is set below the first panel 11, creating a space 17 sufficient to hold at least one inflatable bladder (illustrated as 19*a* and 19*b* in FIG. 2). The panels 11 and 12 cause the NBRD 10 to be neutrally buoyant with the water, when the bladder(s) 19*a* and 19*b* are in an uninflated condition. As a result, the NBRD 10 is easily submerged under the liquid surface and under the immobile object. Upon inflation, the bladder(s) 19*a* and 19*b* enable the NBRD 10 to become positively buoyant and float the object to the surface. As a result, any object on the first panel 11 is easily maneuvered through a liquid as the NBRD 10 glides on the surface.

Figure 2:
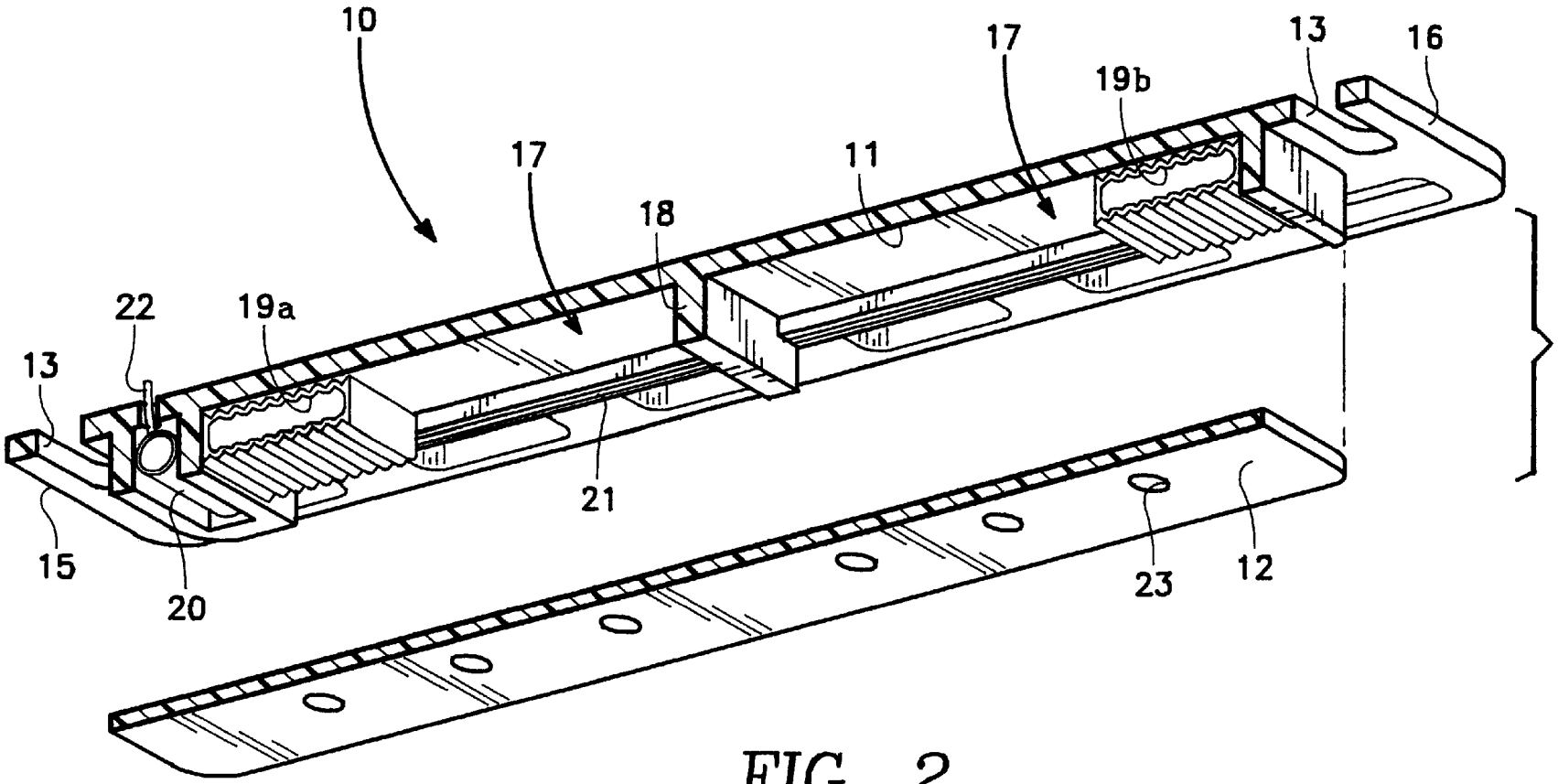
FIG. 2 is a perspective, cross sectional, angular view of a preferred embodiment of the present invention, which illustrates the interaction of the first and second panels.

Referring to FIG. 4, in a preferred embodiment of the present invention, an air cartridge 20 is in connection with the bladder 19*a* and may be used to inflate the bladders 19*a* and 19*b* after the object has been secured to the top panel 11. The air cartridge 20 may be connected to the bladders 19*a* and 19*b* by means of a pipe or conduit 21 that may be located inside rim 24 of the first panel, as illustrated in FIG. 4. As the cartridge 20 inflates the bladders 19*a* and 19*b* simultaneously, the NBRD 10 obtains positive buoyancy. This causes the NBRD 10 to float easily on the liquid surface. Referring to FIG. 2, the bladders 19*a* and 19*b* may be inflated manually with a tube 22 connected directly to the bladder connected to the bow 19*a*. The tube 22 is equipped with a one-way air intake valve to prevent air from escaping as a rescuer inflates the bladders 19*a* and 19*b* by blowing into the tube.

As illustrated in FIGS. 1 and 3, connected to each bladder 19*a* and 19*b* is an inflation valve 80*a* and 80*b*, preferably a one-way inlet valve, for allowing inflating air to enter into each bladder 19*a* and 19*b*. The air cartridge 20 is in flow communication with each bladder 19*a* and 19*b* via an inflation connector, such as a pipe or conduit 21, attached to each inflation valve 80*a* and 80*b*. Also, a manual pressure release valve 82 connected to the inlet of the manual inflation tube 22 permits a rescuer to adjust the buoyancy for objects of varying weight. Other features may include automatic pressure relief valves 85*a* and 85*b* and quick release fittings (not shown). The pressure relief valves 85*a* and 85*b* are for discharging air from each bladder 19*a* and 19*b* and preventing damage caused by overinflation. The quick release fittings (not shown) for the inflation valves 80*a* and 80*b* allow air lines 21 connected to the source of inflating air to be attached and removed rapidly. The pressure relief valves 85*a* and 85*b* may be fitted with a cover (not shown) that will prevent them from functioning when a higher inflation pressure is desired for particular rescue operations. These covers (not shown) are preferably brightly colored for higher visibility so that a rescuer is alerted when the covers are in place. The inflation valves 80*a* and 80*b* manual pressure release valve 82 and pressure relief valves 85*a* and 85*b* are preferably constructed of brass or other non-ferrous metals to prevent corrosion.

Figure 5:
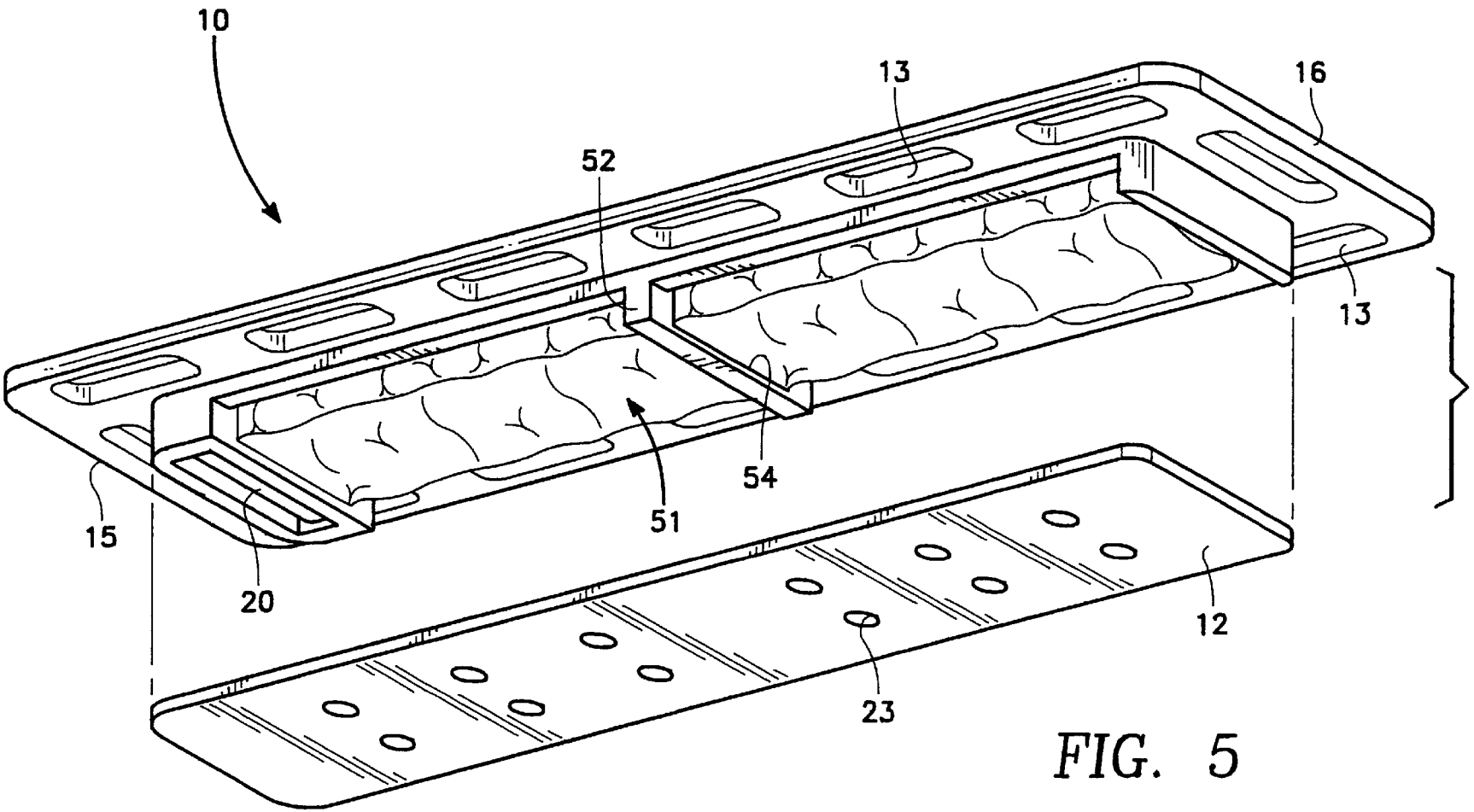
FIG. 5 illustrates a preferred embodiment of the present invention in which one inflatable bladder is utilized.
Figure 6:
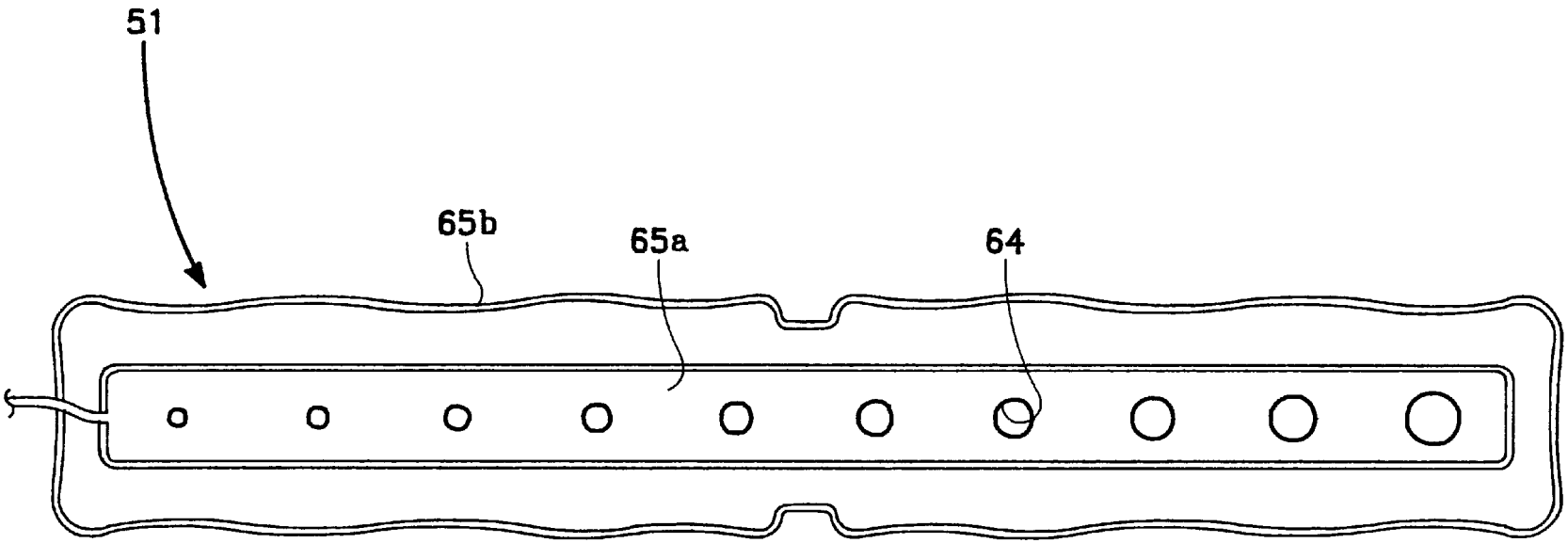
FIG. 6 a cross sectional view of a preferred embodiment of the present invention when one inflatable bladder is utilized which details the inner perforations of the one bladder.

Referring to FIG. 6, a preferred embodiment of the present invention incorporates one bladder 51, where air is uniformly distributed throughout the bladder 51. The bladder 51 is attached to the second panel 12 longitudinally. Perforations 64 are distributed evenly throughout the bladder 51, such that the perforations 64 gradually increase in area size from the bow 17 to the stem 18. The perforations 64 separate two sections 65*a* and 65*b* of the bladder 51, the first section 65*a* adjacent to the second panel 12 and the second section 65*b* adjacent to the first section 11. As the bladder 51 is inflated, either manually or automatically with a device such as $CO_2$ cartridge, air enters the first section 65*a* of the bladder 51 at the bow 15 and the air enters evenly distributed throughout the length of the second section 65*b*. Referring to FIG. 5, when one bladder 51 is incorporated, an opening 53 in a rib 52 permits the bladder 51 to be placed through the opening 53, so that the bladder 51 covers the surface of the second panel 12. More than one rib (not shown) may be added to provide greater support.

Referring to FIG. 4, in a preferred embodiment of the present invention, electronic actuation 40 is utilized to inflate two bladders 19*a* and 19*b*, one bladder at the bow 19*a* and the other bladder at the stem 19*b*. Release of gas is initiated at the bow 17 and a delay mechanism enables the gas canisters, located at the bow 17 and stem 18, to begin inflation of the bladders 19*a* and 19*b* toward the center of the NBRD 10 simultaneously. This enables the individual or object to remain in a stable level position as the bladders 19*a* and 19*b* produce positive buoyancy.

Figure 7:
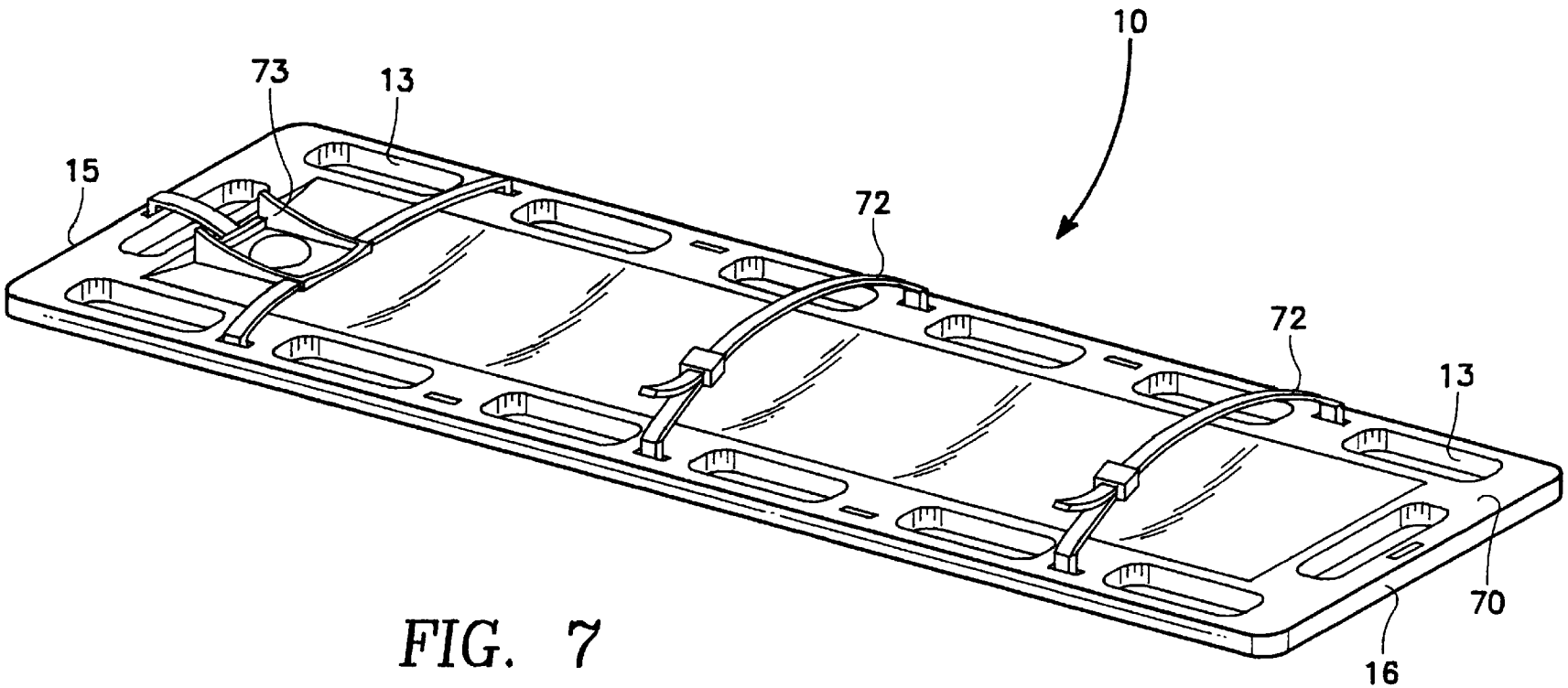
FIG. 7 illustrates a preferred embodiment of the present invention in which the NBRD is used as a water rescue backboard.

Referring to FIG. 7, in a preferred embodiment of the present invention, the NBRD 10 is used as a rescue backboard for extricating an incapacitated victim, from a perilous water area. To better describe the operation of the NBRD 10, the utility as it pertains to a water rescue of an incapacitated victim will be detailed. The following description is not intended to limit the possible utilities of the present invention. In a preferred embodiment of the present invention, two bladders 19*a* and 19*b* are utilized and set at opposite ends of the backboard, as illustrated in FIG. 1. The bladders 19*a* and 19*b* are set, so that they will inflate toward the center of the NBRD 10. This keeps the NBRD 10 and the incapacitated individual parallel to the water and stabilizes the position. In a preferred embodiment of the present invention an air cartridge 20 is set at each end of the NBRD 10 to ensure even inflation of the bladders 19*a* and 19*b*.

Referring to FIG. 1, when used as a water rescue device for individuals with a spinal injury, the NBRD 10 preferably comprises a flat upper surface 11 for receiving and holding the incapacitated individual. A flat surface provides stability to reduce the possibility further injury. For non-spinal injuries, the NBRD 10 preferably comprises a concave upper surface 70 for receiving and holding the incapacitated victim as illustrated in FIG. 7. The concave upper 70 surface tends to maintain positioning of the incapacitated victim thereupon, particularly when the incapacitated victim is initially placed upon the NBRD 10, prior to being secured in position with straps, ropes, webbing, etc 72. The NBRD 10 preferably further comprises a hydrodynamic, concave, foiled, or V-bottomed 31 second panel 12 so as to facilitate hydroplaning and/or improved maneuvering. A hydrodynamic shape is illustrated in FIG. 3. The upper-surface NBRD preferably comprises a polymer material, such as polyethylene, which defines a resilient pad (not shown) upon the first panel 11 of the NBRD 10 so as to increase the comfort and safety of the victim.

Referring to FIG. 7, in a preferred embodiment of the present invention, stabilizing straps 72 are located near where the head, trunk and foot of an incapacitated victim, when the NBRD 10 is utilized in a rescue capacity. Those pair of straps may cross over one another to stabilize the torso area of the patient. Straps 72 would be where the legs of the incapacitated victim would be and straps 72 also go around the torso and/or neck and shoulders of the incapacitated victim. The straps may use VELCRO® portions to connection with one another. Other means, e.g. buckles, etc. may be used to connect the straps 72 to one another. It is apparent that straps or other securing methods may be attached to the NBRD 10 in a wide variety of methods not shown. The straps 72 illustrated in FIG. 7 are merely examples of one embodiment. When transporting an incapacitated victim, who has been secured in the NBRD 10, the rescuer would pull in the direction necessary to facilitate travel through the liquid. In addition, the rescuer may utilize a shoulder or other body part harness (not shown) connected to the bow 15 of the NBRD 10, in order to ease the stress connected with this type of lifesaving operation. For transporting incapacitated victims with spinal injuries, a head restraint 73 may be attached to the NBRD 10.

A preferred embodiment of the present invention provides a backboard 10 designed with neutral buoyancy, which will allow the backboard to be moved easily underwater into the proper position under an incapacitated individual or other relatively immobile object. Once in position under the immobile object, various straps or other securing methods may stabilize the immobile object on the NBRD 10. After securing the immobile object, a compressed air cylinder 20 is activated, inflating at least one bladder on the under side of the NBRD 10 and providing the positive buoyancy required to support the object in the water for easy transfer. Also, the bladder(s) may be inflated manually by blowing into a tube connected to the bladder(s).

Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A device, having a length, a width and a depth, to aid in extricating specified loads from a liquid, comprising:

at least a first and second panel, said first panel juxtaposed above said second panel, wherein said first and second panels define the device's length, width, and depth;

a mechanism affixing said first panel to said second panel, wherein said first and second panels are affixed in a manner establishing an opening between said first and second panels to allow for ingress and egress of the liquid through the opening of said device and wherein said first and second panels are reinforced by said mechanism in meeting the specified loads for said device; and at least one object suitable for inflation with gas, wherein said object is placed in the opening between said first and second panels and wherein said device is neutrally buoyant prior to inflation of said at least one object and said device achieves positive buoyancy upon inflation of said at least one object.

2. The device of claim 1 further comprising at least one rib located between said first and second panels wherein said rib reinforces the opening between said first and second panels.

3. The device of claim 1, wherein said object is an inflatable bladder.

4. The device of claim 3 further comprising a first inflatable bladder having a first inflation valve located at a first end of said device and a second inflatable bladder having a second inflation valve located at a second end of said device, so that said first inflatable bladder and said second inflatable bladder inflate toward the center of said device.

5. The device of claim 4, further comprising an inflation connector adapted to simultaneously connect the first inflation valve and the second inflation valve to a single source of gas for inflating said first and second bladders.

6. The device of claim 1 further comprising a plurality of ties for facilitating securing of the specified loads disposed upon said first panel thereto.

7. The device of claim 1, wherein perforations are incorporated into said second panel, so that the liquid may ingress and egress through said perforations.

8. A water rescue backboard for extricating an individual from water, said rescue backboard having a bow, a stern, and a center comprising:

a first panel adapted to carry an individual and a second panel juxtaposed below said first panel, wherein said first and second panels are connected at the bow and stern and wherein an opening between said first and second panels allows for ingress and egress of water through the opening between said first and second panels;

at least one inflatable bladder, wherein said inflatable bladder is placed in the opening between said first and second panels;

means for securing said first and second panels together to form one unit;

at least one rib located between said first and second panels, wherein said rib reinforces the opening between said first and second panels; and means for inflating said inflatable bladder, wherein said device is neutrally buoyant prior to inflation of said at least one inflatable bladder and wherein said device achieves positive buoyancy upon inflation of said at least one inflatable bladder.

9. The rescue backboard of claim 8, wherein said means for inflating is a $CO_2$ cartridge attached to said inflatable bladder.

10. The rescue backboard of claim 8, wherein said means for inflating is a manual inflation tube attached to said inflatable bladder.

11. The rescue backboard of claim 8, further comprising a first inflatable bladder having a first inflation valve located at the bow and a second inflatable bladder having a second inflation valve located at the stem, so that said first inflatable bladder and said second inflatable bladder inflate toward the center of said rescue backboard.

12. The rescue backboard of claim 11, further comprising an inflation connector adapted to simultaneously connect the first inflation valve and the second inflation valve to a single source of gas for inflating said first and second bladders.

13. The rescue backboard of claim 12, further comprising a first pressure relief valve extending outwardly from said first bladder and a second pressure relief valve extending outwardly from said second bladder, wherein said first and second pressure relief valves are separate and apart from the first and second inflation valves, and wherein said first pressure relief valve being in fluid communication with said first bladder releases gas from said first bladder, and the second pressure relief valve being in fluid communication with said second bladder releases gas from said second bladder.

14. The rescue backboard of claim 8, wherein said rib is located at the longitudinal center of the opening between said first and second panels, wherein said rib reinforces the opening between said first and second panels.

15. The rescue backboard of claim 8, wherein said first panel further comprises handhold apertures adjacent to the lateral edges of said first panel.

16. The rescue backboard of claim 8, wherein said second panel is smaller in area than said first panel.

17. The rescue backboard of claim 8, wherein said first panel further comprises a concave surface for receiving and holding the individual.

18. The rescue backboard of claim 8, wherein said first and second panels are connected at the bow of said rescue backboard, so that a hydrodynamic shape is formed which reduces water resistance.

19. The rescue backboard of claim 8, wherein perforations are incorporated into said second panel, so that the water may ingress and egress through said perforations.

* * * * *